US006338621B1

(12) United States Patent
Vuyk, Jr. et al.

(10) Patent No.: US 6,338,621 B1
(45) Date of Patent: Jan. 15, 2002

(54) VOLUME REDUCTION MANDREL FOR USE IN PNEUMATIC ISOSTATIC FORGING

(75) Inventors: Adrian Vuyk, Jr., Houston; Jeffery E. Daly, Cypress, both of TX (US)

(73) Assignee: Camco International, Inc., Houston, TX (US)

( * ) Notice: Subject to any disclaimer, the term of this patent is extended or adjusted under 35 U.S.C. 154(b) by 0 days.

(21) Appl. No.: 09/492,731

(22) Filed: Jan. 27, 2000

Related U.S. Application Data

(62) Division of application No. 09/190,804, filed on Nov. 11, 1998, now Pat. No. 6,060,016.

(51) Int. Cl.[7] ..... B22F 3/04
(52) U.S. Cl. ..... 425/78
(58) Field of Search ..... 419/28; 425/78

(56) References Cited

U.S. PATENT DOCUMENTS

| | | | | |
|---|---|---|---|---|
| 4,539,175 A | | 9/1985 | Lichti et al. | |
| 4,562,892 A | | 1/1986 | Ecer | |
| 4,592,252 A | | 6/1986 | Ecer | |
| 4,856,311 A | | 8/1989 | Conaway | |
| D304,610 S | | 11/1989 | Conaway | |
| 4,942,750 A | | 7/1990 | Conaway | |
| 5,032,351 A | | 7/1991 | Meeks | |
| 5,110,542 A | | 5/1992 | Conaway | |
| 5,113,583 A | * | 5/1992 | Jenkel et al. | 29/889.21 |
| 5,137,663 A | | 8/1992 | Conaway | |
| 5,561,834 A | | 10/1996 | Score | |
| 5,653,299 A | | 8/1997 | Sreshta et al. | |
| 5,816,090 A | | 10/1998 | Hodge et al. | |
| 5,967,248 A | | 10/1999 | Drake | |

* cited by examiner

*Primary Examiner*—Daniel J. Jenkins
(74) *Attorney, Agent, or Firm*—Jeffery E. Daly

(57) ABSTRACT

A densified sintered product, such as a rolling cutter adapted for use in a steel tooth rolling cutter earth boring bit, has a layer of a metal powder applied to the external surface of the unsintered compact, the metal powder being melted to form a thin glaze of the melted metal powder on the external surface of the sintered compact, and the sintered compact may then be pneumatically isostatically forged.

4 Claims, 2 Drawing Sheets

FIG. 1
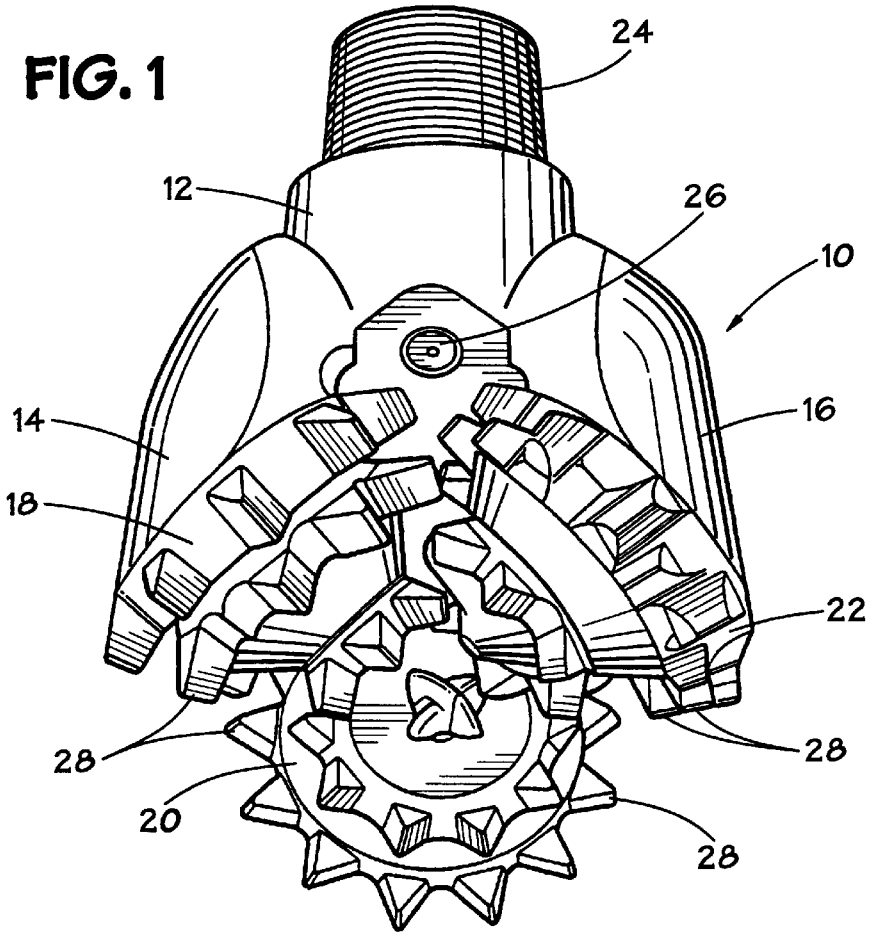
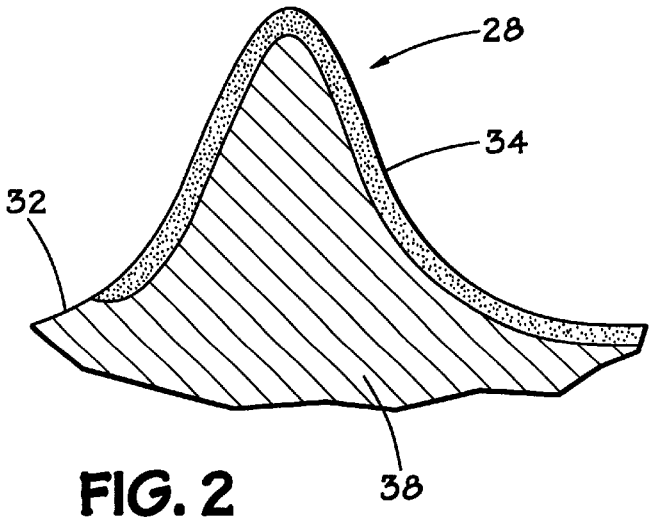
FIG. 2

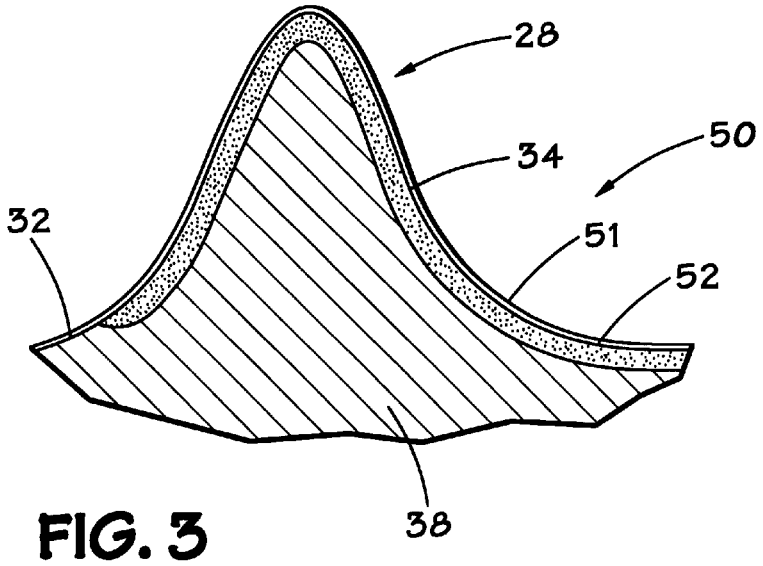
FIG. 3
FIG. 4
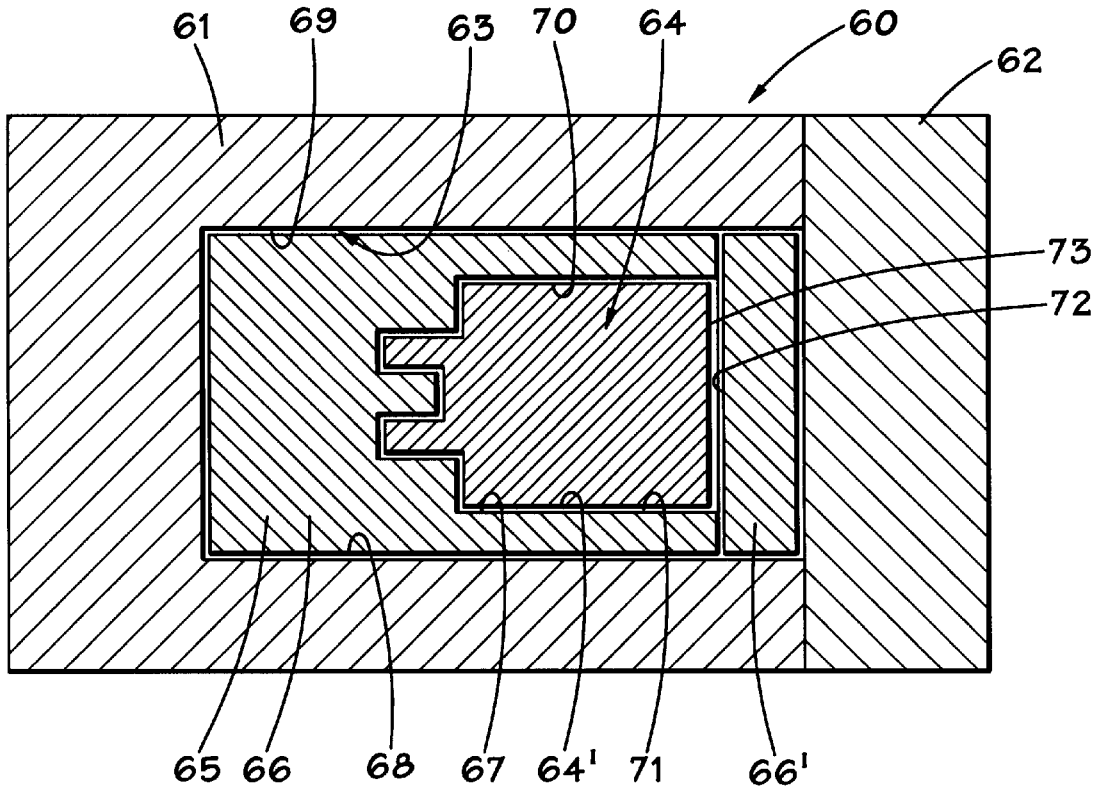

VOLUME REDUCTION MANDREL FOR USE IN PNEUMATIC ISOSTATIC FORGING

RELATED APPLICATION

This application is a divisional application of U.S. patent application Ser. No. 09/190,804, filed Nov. 11, 1998, now U.S. Pat. No. 6,060,016.

BACKGROUND OF THE INVENTION

1. FIELD OF THE INVENTION

This invention relates to pneumatic isostatic forging of sintered compacts, including pneumatic isostatic forging of a rolling cutter adapted for use in a steel tooth rolling cutter drill bit utilized for drilling bore holes in the earth, the rolling cutter having a layer of wear resistant material, such as a hardmetal facing.

2. DESCRIPTION OF THE RELATED ART

It is well known to make sintered products by compacting metal powder, such as a plurality of iron, or steel alloy, particles in a die to form an unsintered compact, typically called a "green" compact, and then heating the green compact to a suitable temperature for a time sufficient to effect solid state bonding, or sintering, of the particles to each other. One type of compaction process is an isostatic process using a gas pressing medium known as the PIF process, which stands for pneumatic isostatic forging.

The PIF process has been used to densify sintered compacts wherein the sintered compact is encased in a shell which seals its outer surface against penetration of the gaseous pressing medium into the interior of the sintered compact. The sintered compact is then heated back up to the sintering temperature and then may be surrounded by, and subjected to, pressing gas pressures sufficiently high (up to 60,000 PSI) as to densify the sintered compact. The sealing shell make take several forms, as are known in the prior art, including placing the compact in an evacuated thin flexible sheet metal can or mold; or applying a sealant, such as molten glass, electroless nickel, or an oxide sealant grown in situ on the surface of the compact to seal the surface pores.

It is also known to form densified sintered products which have a layer of wear resistant material to a portion of the external surface of the sintered product. An example of such a product is a rolling cutter adapted for use in a steel tooth rolling cutter earth boring bit utilized for drilling bore holes in the earth for the minerals mining industry. In the production of such rolling cutters, hardmetal inlays or overlays are employed as wearing and deformation resistant cutting edges and faying surfaces. These typically comprise composite structures of hard particles in a more ductile metal matrix. The hard particles may be metal carbides, such as either the cast WC/W2 eutectic or monocrystalline WC, or may themselves comprise a finer cemented carbide composite material. The hard particles which could be used include tungsten carbide, tungsten carbide/cobalt, titanium carbide, and commercially available ceramic carbides.

A major problem in forming densified sintered products, such as a rolling cutter having a layer of wear resistant material on it, utilizing a PIF, or pneumatic isostatic forging, process, is that the PIF process typically requires a relatively long period of time to sinter the green compact. This long sintering period, typically at an elevated temperature of approximately 2000° F. will, it is believed, either destroy, or at least severely damage, any wear resistant material placed on the unsintered green compact, such as the hard particles previously discussed. In the case of a green compact formed of steel alloy powder and a tungsten carbide wear resistant layer, the prolonged heating, at elevated temperatures, leads to the steel alloy attempting to draw out, or suck out, the carbon atoms from the tungsten carbide wear resistant layer, thus either destroying, or severely damaging, the wear resistant layer. Additionally, some of the prior art techniques for sealing the outer surface of the sintered compact in the PIF process may have some disadvantage for some types of products. For example, additional manufacturing steps may be necessary to remove the sealing material, such as molten glass, nickel or oxide sealant, for the end product to be used. Additionally, such sealing materials could be a contaminant to some sintered compacts.

Accordingly, prior to the development of the present invention, it is believed that there has been no method of forming a densified sintered product from a metal powder, particularly when the sintered product includes a layer of wear resistant material thereon, by a pneumatic isostatic forging process, which: does not destroy, or severely damage, the wear resistant material; does not require additional manufacturing steps to remove a sealing material; and does not contaminate the sintered product with a sealing material. Therefore, the art has sought a method of forming a densified sintered product by a pneumatic isostatic forging process, which: does not destroy, or severely damage, a layer of wear resistant material that may form a part of the sintered product; does not require additional manufacturing steps to remove a sealing material; and does not contaminate the sintered product with a sealing material.

SUMMARY OF THE INVENTION

In accordance with the invention, the foregoing advantages have been achieved through the present method of forming a densified sintered product from a first metal powder, the powder having a first melting temperature. The present invention includes the steps of: compacting the first metal powder in a die to form an unsintered compact having an external surface; applying a layer of a second metal powder to the external surface of the unsintered compact, the second metal powder having a second melting temperature, the second melting temperature being lower than the first melting temperature; heating the unsintered compact to a temperature greater than the second melting temperature and less than the first melting temperature, to form a sintered compact of the first metal powder and to melt the second metal powder to form a thin glaze of the melted second metal powder on the external surface of the sintered compact; and pneumatically isostatically forging the sintered compact. Another feature of the present invention may include the step of providing a layer of wear resistant material to a portion of the external surface of the unsintered compact prior to applying a layer of the second metal powder.

A further feature of the present invention is that the densified sintered product to be formed may be a rolling cutter adapted for use in a steel tooth rolling cutter earth boring bit. Another feature of the present invention is that the densified sintered product to be formed may be a component of a drag type earth boring bit. The wear resistant material may be a hardmetal composite structure which includes a plurality of hard particles. In accordance with the invention, the hard particles may include tungsten carbide, titanium carbide, and/or ceramic carbide. The first metal powder may be a powder of steel alloy particles, and the second metal powder may be an iron powder. A further feature of the present invention is that the heating of the unsintered compact may be done at a temperature of approximately 2050° F.

In accordance with another aspect of the present invention, the foregoing advantages may also be achieved in the present method of forming a densified sintered product from a metal powder, having a first melting temperature. In accordance with this aspect of the present invention, the method includes the steps of: compacting the metal powder in a die to form an unsintered compact having an external surface; applying a layer of a metallic material to the exterior surface of the unsintered compact, the metallic material having a second melting temperature, the second melting temperature being lower than the first melting temperature; heating the unsintered compact to a temperature greater than the second melting temperature, and less than the first melting temperature, to form a sintered compact of the metal powder and to melt the layer of metallic material to form a thin glaze of the melted material on the external surface of the sintered compact; and pneumatically isostatically forging the sintered compact. A further feature of this aspect of the present invention is that the layer of material is formed of a metallic material that upon melting becomes integral with the sintered compact.

In accordance with another aspect of the present invention, the foregoing advantages may also be achieved in the present volume reduction mandrel, for use with at least one sintered compact to be placed in a pressure vessel used in a pneumatic isostatic forging process, wherein the pressure vessel has a hollow body member and an inner cavity, and the at least one sintered compact has an exterior shape. In accordance with this aspect of the present invention, the volume reduction mandrel includes: a mandrel body member having an exterior surface and an interior cavity, the interior cavity closely conforming to the exterior shape of the sintered compact, the interior cavity being adapted to slidingly receive therein the sintered compact; and the mandrel body member, when disposed within the inner cavity of the pressure vessel, provides a small clearance between the exterior surface of the mandrel body and the inner cavity of the pressure vessel and the mandrel body member substantially fills the inner cavity of the pressure vessel. Another feature of this aspect of the present invention is that the volume reduction member may include a closure member for the mandrel body member. An additional feature of this aspect of the present invention may include a plurality of mandrel body members, each mandrel body member being adapted to contain a sintered compact, the plurality of mandrel body members substantially filling the inner cavity of the pressure vessel.

The method of forming a densified sintered product from a metal powder, in accordance with the present invention, when compared to previously proposed prior art methods of forming densified sintered products, has the advantages of: not destroying, or severely damaging, the layer of wear resistant material which may be included in the sintered product; not requiring additional manufacturing steps; and not contaminating the sintered compact.

The volume reduction mandrel, in accordance with the present invention, when compared to previously proposed prior art apparatus for use in a pneumatic isostatic forging process, has the advantage of permitting the high pressure gas, which is being injected into the isostatic forging pressure vessel, to be disposed within as small a volume of space as possible.

BRIEF DESCRIPTION OF THE DRAWING

IN THE DRAWING:

FIG. 1 is a perspective view of a typical steel tooth rolling cutter earth boring drill bit;

FIG. 2 is a cross-sectional view of a tooth and a portion of the exterior surface of the rolling cutter of the drill bit of FIG. 1;

FIG. 3 is a cross-sectional view of an unsintered compact which becomes the tooth of the drill bit illustrated in FIG. 2; and FIG. 4 is a cross-sectional view of a pressure vessel useful in an pneumatic isostatic forging process.

While the invention will be described in connection with the preferred embodiment, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF THE PREFERRED EMBODIMENT

Referring now to the Drawing in more detail, and particularly to FIGS. 1 and 2, a typical steel tooth rolling cutter drill bit, or rock bit 10, is shown. The bit 10 has a body 12 with three legs 14, 16, the third leg not being shown. Upon each leg 14, 16 is mounted a rolling cutter 18, 20, 22. During operation, the bit 10 is secured to drill pipe (not shown) by threads 24. The drill pipe (not shown) is rotated and drilling fluid (not shown) is pumped through the drill pipe to the bit 10 and exits through one or more nozzles 26. The weight of the string of drill pipe forces the cutting teeth 28 of the cutters 18, 20, 22, into the earth, and as the bit is rotated, the cutters 18, 20, 22, rotate upon the legs 14, 16, effecting a drilling action. Typically, the cutting teeth 28 are coated with some form of wear resistant material to maintain the tooth sharpness as the bit 10 drills through the earth.

Hardmetal inlays, or overlays, may be employed in bit 10 as wear and deformation resistant cutting edges and faying surfaces. These typically comprise composite structures of hard particles in a more ductile metal matrix. The hard particles may be metal carbide, such as either the cast WC/W2 eutectic or monocrystalline WC, or may themselves comprise finer cemented carbide composite material, as is known in the art. As previously described, the hard particles may include tungsten carbide, tungsten carbide/cobalt, titanium carbide, or various ceramic carbides, as are known in the art.

With reference to FIG. 2, the tooth 28 and the exterior surface 32 of the rolling cutter of a drill bit 10 is shown with a hardmetal inlay 34 of a type previously described, made into both the tooth 28 and the outer surface 32 of the rolling cutter 20. Typically, the interior body 38 of cutters 18, 20, 22, is formed of a steel alloy material, as is known in the art. The rolling cutters 18, 20, 22, may be formed as a densified sintered product as will be hereinafter described in greater detail.

As is known in the art, the first step in forming a densified sintered product utilizing a pneumatic isostatic forging process, is to form a green, or unsintered, compact. For illustrative purposes, the method of the present invention will be described in connection with forming a rolling cutter, such as rolling cutter 20 illustrated in FIG. 1, although other types of bit components, bits and products could be made with the method of the present invention. The metal powder, such as a metal powder formed of a plurality of steel alloy particles, is compacted, in a conventional manner, in a die to form an unsintered compact in the shape of, for example, rolling cutter 20 of FIG. 1. The die may be a flexible, or resilient, die or a rigid die, all as are well known in the art.

In the case of a rolling cutter 20 having a layer 34 of wear resistant material, as previously described, on a portion of the external surface 32 (FIG. 2) of the unsintered compact, the layer 34 of wear resistant material may also be provided as a powder placed over the metal powder form the interior body 38 of the unsintered compact.

With reference to FIG. 3, a portion of the unsintered compact 50, or tooth 28, is illustrated. After the unsintered compact has been formed, a layer 51 of a second metal powder 52, as will hereinafter be described in greater detail, is applied to the external surface 32 of the unsintered compact 50. The second metal powder 52 preferably has a melting temperature, or second melting temperature, which is lower than the melting temperature, or first melting temperature, of the first metal powder used to for the interior body 38 of cutter 18. After the layer 51 of second metal powder 52 has been applied, the unsintered compact 50 is heated in a conventional manner to a temperature which is greater than the melting temperature of the metal powder 52, which temperature is also less than the melting temperature of the metal powder which forms the interior body 38 of unsintered compact 50. This heating step forms a sintered compact of the first metal powder, which in the case of rolling cutter 20, also includes layer 34 of the wear resistant material. Additionally, the heating step melts the layer 51 of the second metal powder 52 to form a thin glaze of the second metal powder 52 on the external surface 32 of the sintered compact, including covering the layer 34 of the wear resistant material. The sintered compact so formed, may then be densified, as is known in the art, by pneumatically isostatically forging the sintered compact. In this regard, U.S. Pat. Nos. 4,856,311; 4,942,750; 5,110,542; and 5,816,090 are directed to the PIF or pneumatic isostatic forging process, and these patents are incorporated herein by reference. The thin glaze of the melted second metal powder seals all of the pores of the sintered compact and the glaze becomes integral with the sintered compact.

Preferably, the second metal powder is a powder formed of iron particles. One iron powder is believed to be particularly useful in practicing the present invention and is known as Carbonyl Iron Powder sold by BASF Corporation. When that material is used as the second metal powder, and the first metal powder is a steel alloy powder, the heating of the unsintered compact is preferably done at a temperature of approximately 2050° F., whereby the second metal powder will melt as desired to form the thin glaze, and the first metal powder will be heated to form a sintered compact 50. The thin glaze formed by the melting of layer 51 of the second metal powder 52 may also serve to seal the outer surface of the sintered compact against penetration of the gaseous pressing medium into the interior of the sintered compact 50 during the PIF process. This thin glaze formed by the melted second metal powder may not have to be removed, or be subject to additional manufacturing steps, dependent upon the type of densified sintered product being made, as well as may not contaminate the densified sintered product being made.

In addition to the iron powder previously described for use as the second metal powder, any metallic material having the following characteristics and qualities could be used in lieu of the second metal powder. For example, any powder form of an iron alloy having a melting temperature of approximately 1000°–2000° F. would be useful when the interior body 38 has been formed of a powder of steel alloy particles. It is also believed that pure iron powder would work satisfactorily in the method of the present invention. The iron alloy or pure iron must not be a contaminant to the structure of the wear resistant layer, when the material is applied to an unsintered compact which includes a layer of wear resistant material. In general, the material to be used to provide a thin glaze of a melted material on the external surface of the sintered compact should be a metallic material that becomes integral with the sintered compact upon melting. This metallic material may be applied in powder form, as previously described, or by dipping the unsintered compact into the metallic material. Alternatively, the layer of metallic material my be applied by spraying or any other conventional deposition process.

With reference to FIG. 4, a pressure vessel 60 useful in a PIF or pneumatic isostatic forging, process is shown. Pressure vessel 60, or pressure-containment vessel, includes a hollow body member 61 which is closed by a lid, or closure, member 62. Hollow body member 61 has an interior cavity 63 into which the high pressure gas used in the PIF process may enter through any suitable passageway. In the conventional PIF process, as described in the three previously incorporated by reference patents, a "can" containing the sintered compacts to be further densified are placed within the pressure vessel, or pressure containment vessel, 60 as illustrated in those patents, and the "can" (not shown) is disposed within the cavity 63 of the pressure vessel 60, and subjected to the high pressure gas.

In accordance with the present invention, a sintered compact 64 to be subject to PIF processing, may be disposed within a two-part volume reduction mandrel 65, as will be hereinafter described in greater detail. Volume reduction mandrel 65 includes a body member 66 having an interior cavity 67 which closely conforms to the exterior shape 64' of sintered compact 64, and the volume mandrel 65 slidingly receives sintered compact 64 therein. The volume reducing mandrel body member 66 substantially fills the interior cavity 63 of the pressure vessel 60, as shown in FIG. 4. The volume reducing mandrel 65 has a closure member 66' which substantially fills the remaining volume of cavity 63 within pressure vessel 60, as shown in FIG. 4. In the PIF process, it would be desirable to have the high pressure gas which is being injected into the pressure vessel 60 be disposed within as small a volume of space as possible. Accordingly, the high pressure gas (not shown) being injected within cavity 63 is only disposed within the small clearance between the exterior surface 68 of volume reduction mandrel body member 66 and the interior surface 69 of cavity 63, as well as in the volume of space between the exterior surface 70 of sintered compact 64 and the interior surface 71 of the cavity 67 formed within volume reduction mandrel body member 66. Additionally, the high pressure gas being injected within pressure vessel 60 will also be disposed between the inner facing surface 72 of volume reduction mandrel closure member 66' and the oppositely disposed surface 73 of sintered compact 64. Accordingly, the high pressure gas is confined within a relatively small volume within the cavity 63 of pressure vessel 60. Although a two part volume reduction mandrel 65 is illustrated, it will be readily apparent to one of ordinary skill in the art that the volume reduction mandrel body member 66 could be sized to fill the entire cavity 63 of pressure vessel 60, and the outwardly facing surface 73 of sintered compact 64 would be disposed in close proximity to the lid 62 of pressure vessel 60, whereby closure member 66' would not be necessary. Of course, alternatively, if desired, more than two volume reduction mandrels could be utilized. The sintered compact 64 may have its outer surface sealed to prevent the high pressure gas from entering the interior of the sintered compact 64 by either the method of the present invention, or by any prior art method for sealing the outer surface of the sintered compact 64.

The reduction mandrel 65 may be made of any suitable ceramic, metallic or plastic material capable of withstanding the high temperature and high pressure forces to which it is subjected. For example, the mandrel 65 may be made of steel.

It is to be understood that the invention is not limited to the exact details of construction, operation, exact materials or embodiments shown and described, and it is obvious modifications and equivalents will be apparent to one skilled in the art. For example, drag bits and components thereof, as well as stabilizer components, could be formed by the practice of the method of the present invention. Accordingly, the invention is therefore to be limited only by the scope of the appended claims.

What is claimed is:

1. A volume reduction mandrel, for use with at least one sintered compact to be placed in a pressure vessel used in a pneumatic isostatic forging process, the pressure vessel having a hollow body member and an inner cavity, and the at least one sintered compact having an exterior shape, comprising:

a mandrel body member having an exterior surface, an interior surface, and an interior cavity, the interior cavity closely conforming to the exterior shape of the sintered compact, the interior cavity being adapted to slidingly receive therein the sintered compact; and the mandrel body member, when disposed within the inner cavity of the pressure vessel, provides a small clearance between the exterior surface of the mandrel body and the inner cavity of the pressure vessel, the interior cavity of the mandrel body member provides a space which separates the interior surface of the mandrel body member from the exterior shape of the sintered compact, and the mandrel body member substantially fills the inner cavity of the pressure vessel;

wherein the inner cavity of the pressure vessel and the interior cavity of the mandrel body member receive pressurized gas during pneumatic isostatic forging.

2. The volume reduction mandrel of claim 1, further including a closure member for the mandrel body member.

3. The volume reduction mandrel of claim 1 further including a plurality of mandrel body members, each mandrel body member being adapted to contain a sintered compact, the plurality of mandrel body members substantially filling the inner cavity of the pressure vessel.

4. The volume reduction mandrel of claim 1, wherein the mandrel is made from a material selected from the group consisting of ceramics, plastics, and metals.

* * * * *